US007694396B2

(12) United States Patent
Ogura

(10) Patent No.: US 7,694,396 B2
(45) Date of Patent: Apr. 13, 2010

(54) REVERSE OPENING TYPE SEPARABLE END STOP OF SLIDE FASTENER

(75) Inventor: Suguru Ogura, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/974,784

(22) Filed: Oct. 16, 2007

(65) Prior Publication Data

US 2008/0092347 A1 Apr. 24, 2008

(30) Foreign Application Priority Data

Oct. 20, 2006 (JP) ..... 2006-286654

(51) Int. Cl.
*A44B 19/38* (2006.01)

(52) U.S. Cl. ..... 24/433

(58) Field of Classification Search ..... 24/386, 24/433, 434, 436

See application file for complete search history.

(56) References Cited

U.S. PATENT DOCUMENTS 4,090,279 A * 5/1978 Wasko ..... 24/386
6,009,602 A * 1/2000 Terada ..... 24/433
6,615,458 B2 * 9/2003 Takasawa et al. ..... 24/433
2006/0282998 A1 12/2006 Kusayama et al.

FOREIGN PATENT DOCUMENTS

EP 1 201 147 A1 5/2002
EP 1 570 758 A1 9/2005
JP 3621040 5/2002

OTHER PUBLICATIONS

European Search Report for EP 07020128.0, dated Jan. 28, 2008.

* cited by examiner

*Primary Examiner*—James R Brittain
(74) *Attorney, Agent, or Firm*—Alston & Bird, LLP

(57) ABSTRACT

The present invention provides a reverse opening type separable end stop having a mechanism which securely locks a reverse opening type slider on a surface of an insert pin or a box pin, thereby blocking the slider from needlessly moving inward, wherein the reverse opening type separable end stop comprises a reverse opening type slider, a box pin and an insert pin, the insert pin or the box pin being provided with a contact portion with which a locking pawl provided on the reverse opening type slider mounted on a fastener chain can always make contact by colliding an end surface thereof in an opening/closing direction at an end portion of the fastener chain, so that the contact portion is locked by the locking pawl, whereby a high quality reverse opening type separable end stop is ensured.

3 Claims, 16 Drawing Sheets

REVERSE OPENING TYPE SEPARABLE END STOP OF SLIDE FASTENER

BACKGROUND OF THE INVENTION

1. Field of the Invention

The present invention relates to a reverse opening type separable end stop of a slide fastener, and more particularly to a reverse opening type separable end stop which enables a smooth separable end stop operation by improving a box pin and an insert pin of the reverse opening type separable end stop including a reverse opening type slider, the box pin and the insert pin.

2. Description of the Related Art

A slide fastener has been used as not only an opening/closing device of an opening portion of clothes or a bag but also a connecting device of carpet or artificial lawn divided to a unit size. Although such a type of slide fastener that can be opened or closed from one end side to the other end side in a longitudinal direction of a fastener chain is a general type, there exists another type which can be opened or closed from both end sides in the longitudinal direction of the fastener chain. In this type of slide fastener, two sliders, that is, an opening type slider and a reverse opening type slider are disposed on its fastener chains, and a box pin and an insert pin are attached to one end of the fastener chain, so that a reverse opening type separable end stop comprised of the reverse opening type slider, box pin and insert pin is mounted.

As a conventional reverse opening separable end stop, one shown in FIG. 16 has been known (see, for example, Japanese Patent No. 3621040). A recess 118 is provided on a side surface of the insert pin 104 and a small piece 122 is provided projectingly on a side surface of the box pin 103 opposing the side surface of the insert pin 104, so that the small piece 122 can be inserted into the recess 118 when the box pin 103 and the insert pin 104 are inserted into the reverse opening type slider 101. A rising slope 117 is formed from a front end of the insert pin 104 toward its proximal end side. When the insert pin 104 is inserted into the reverse opening type slider 101, the slope 117 of the insert pin 104 makes contact with a locking pawl 135 provided on the reverse opening type slider 101, and as the insert pin 104 is moved, the insert pin 104 pushes up the locking pawl 135, so that the locking pawl 135 can ride on a top surface of the insert pin 104. A concave portion 113 in which the locking pawl 135 pushed up to the top surface of the insert pin 104 can be inserted is provided on the proximal end side of the insert pin 104 relative to the slope 117, that is, at a position adjacent to the fastener element. With the insert pin 104 inserted into the reverse opening type slider 101, the locking pawl 135 is held in the concave portion 113. Further, a slope 120 for the locking pawl 135' of the opening type slider 102 to ride on a top surface of the box pin 103 is formed on the proximal end of the box pin 103.

Recently, the slide fastener provided with the reverse opening separable end stop has been mounted to articles in various fields and additionally, mounted in different usage style from a conventional usage style. According to the conventional usage style, when the slide fastener is attached to an article, the reverse opening separable end stop has been disposed on a bottom side of the article. According to a new usage style, on the other hand, the reverse opening separable end stop has been disposed on an upper side of an article, for example, an over pants which a skier wears.

When the insert pin is inserted into the reverse opening type slider in the reverse opening separable end stop of the slide fastener shown in FIG. 16, the locking pawl of the reverse opening type slider is fitted into the concave portion formed in the top surface of the insert pin and maintained. When the reverse opening separable end stop is disposed on an upper side of an article, the reverse opening type slider swings during usage, so that it may be about to move downward of the article due to its own weight, that is, move freely in a direction of departing from the box pin and the insert pin. However, the insert pin and box pin do not have a function of stopping a movement of the reverse opening type slider, and there occurs a problem that the fastener elements may be separated naturally without any intentional operation of the reverse opening type slider.

SUMMARY OF THE INVENTION

The present invention has been achieved in view of the above-described problems, and a first object of the present invention is to provide a reverse opening type separable end stop of a slide fastener, which can prevent a reverse opening type slider from moving inward of a fastener chain without any reason even when the reverse opening type separable end stop is disposed in an upper side of an article by providing an insert pin or a box pin of the reverse opening type separable end stop with a contact portion with which a locking pawl of the reverse opening type slider makes contact.

In addition to the first object, a second object of the present invention is to provide a reverse opening type separable end stop of a slide fastener, which secures a contact between the locking pawl and the contact portion in the insert pin and allows a smooth insertion operation of the insert pin.

In addition to the first object, a third object of the present invention is to provide a reverse opening type separable end stop of a slide fastener, which secures a contact between the locking pawl and the contact portion in the box pin.

In addition to the first object, a fourth object of the present invention is to provide a reverse opening type separable end stop of a slide fastener, in which the box pin is never an obstacle in a movement path of the contact portion of the insert pin when the insert pin is inserted into the reverse opening type slider, and which allows a smooth insertion operation of the insert pin.

In addition to the first object, a fifth aspect of the present invention is to provide a reverse opening type separable end stop of a slide fastener, which secures a wide area of the contact portion making contact with the locking pawl so as to lock the reverse opening type slider securely.

To achieve the above-mentioned object, according to a first aspect of the present invention, there is provided a reverse opening type separable end stop of a slide fastener, comprising: a box pin attached to one end in a row direction of fastener elements of one fastener stringer of a pair of right and left fastener stringers; an insert pin attached to one end in a row direction of the fastener elements of the other fastener stringer; and a reverse opening type slider in which the box pin and the insert pin are capable of being inserted, wherein the insert pin or the box pin is provided with a contact portion which is opposed to and makes contact with a locking pawl provided on the reverse opening type slider, and when the contact portion comes into contact with the locking pawl, the reverse opening type slider is prevented from moving inward of a fastener chain.

According to a second aspect of the present invention, there is provided the reverse opening type separable end stop of a slide fastener according to the first aspect, wherein the insert pin has the contact portion which is projected from a side surface of the insert pin opposing the box pin, and a notch portion formed from the proximal end of the contact portion to a front end of the insert pin, the notch portion allowing the locking pawl of the reverse opening type slider to invade therein.

According to a third aspect of the present invention, there is provided the reverse opening type separable end stop of a slide fastener according to the first aspect, wherein the box pin has a notch portion formed in a side surface thereof opposing the insert pin, the notch portion allowing the locking pawl of the reverse opening type slider to invade therein, and also has the contact portion provided on a peripheral wall thereof constituting the notch portion.

According to a fourth aspect of the present invention, there is provided the reverse opening type separable end stop of a slide fastener according to the first aspect, wherein the box pin has insertion pieces projecting from a side surface thereof opposing the insert pin, and the insert pin has accommodating portions capable of accommodating the insertion pieces of the box pin on a side surface thereof opposing the box pin and a contact portion projecting toward the box pin while the contact portion and the insertion pieces are disposed at positions deflected in a front and rear surface direction of the box pin and the insert pin.

According a fifth aspect of the present invention, there is provided the reverse opening type separable end stop of a slide fastener according to the first aspect, wherein the insert pin is provided with the contact portion projecting from a side surface thereof opposing the box pin, the contact portion being formed to project such that a width thereof increases gradually from a proximal end side of the insert pin, that is, from a side adjacent to the fastener element toward a front end side.

The invention of this application provides following advantageous effects. According to the first aspect of the invention, even when the reverse opening type slider is about to move inward of the fastener chain unintentionally, the contact portion and the locking pawl make contact with each other, thereby preventing the reverse opening type slider from separating fastener elements to right and left sections without any intentional operation.

According to the second aspect of the present invention, in addition to the effect of the first aspect, the locking pawl of the reverse opening type slider can be brought into contact with the contact portion in the insert pin securely, and when the insert pin is inserted into the reverse opening type slider, a collision between a front end of the insert pin and the locking pawl can be avoided.

According to the third aspect of the present invention, in addition to the effect of the first aspect, the locking pawl of the reverse opening type slider can be brought into contact with the contact portion of the box pin securely.

According to the fourth aspect of the present invention, in addition to the effect of the first aspect, the contact portion of the insert pin never collides with the insertion pieces of the box pin when the insert pin is inserted into the reverse opening type slider, so that the insert pin can be inserted smoothly into the reverse opening type slider.

According to the fifth aspect of the present invention, in addition to the effect of the first aspect, an area of the contact portion making contact with the locking pawl is increased, so that the contact portion and the locking pawl make contact with each other through a wide area, thereby stopping movement of the reverse opening type slider securely. The effects achieved by the present invention are very remarkable.

DESCRIPTION OF THE PREFERRED EMBODIMENTS

Figure 1:
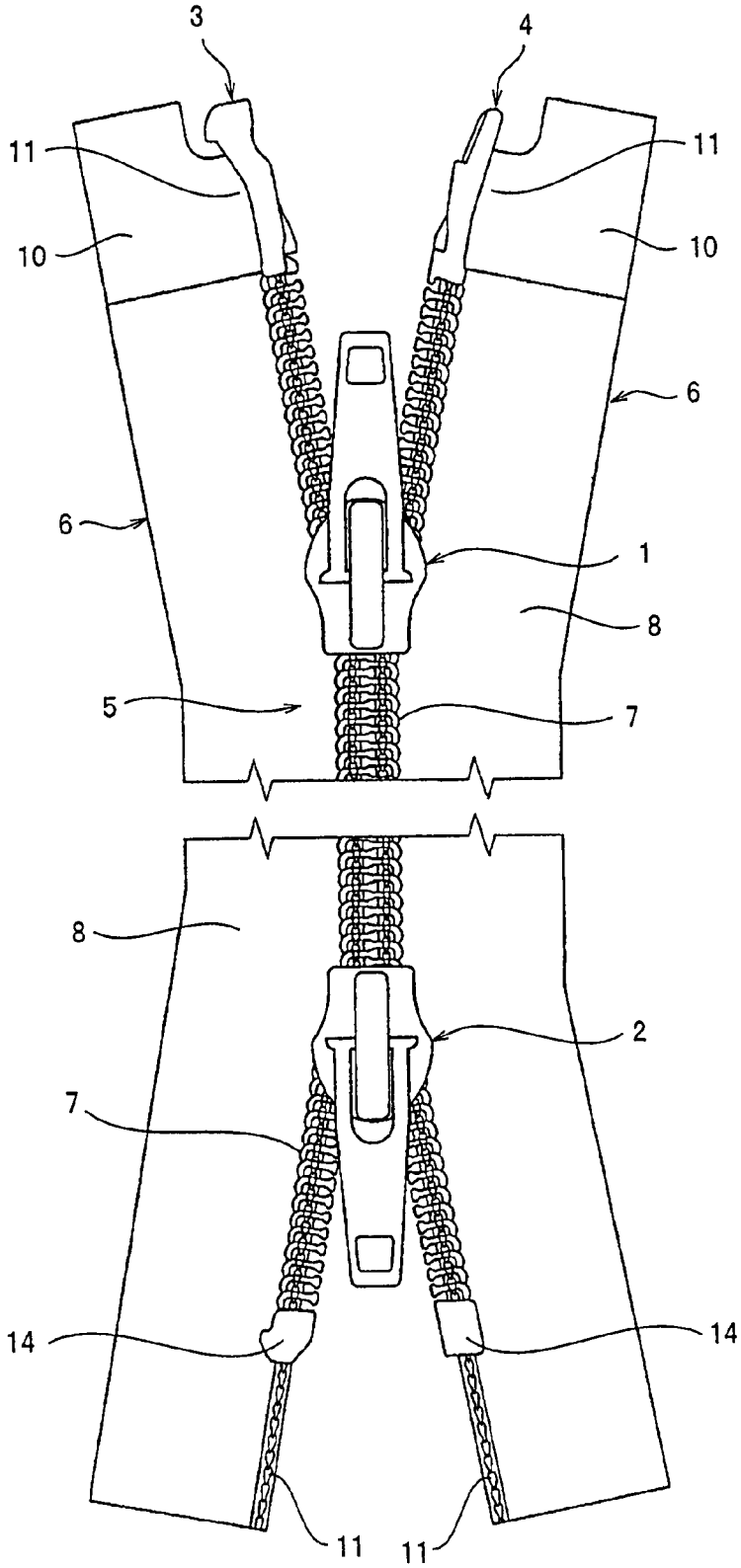
FIG. 1 is a front view of a reverse opening separable end stop according to a first embodiment.

As shown in FIG. 1, a reverse opening type separable end stop of a slide fastener according to the present invention comprises a box pin 3 and a insert pin 4 attached to end portions in a longitudinal direction of a fastener chain 5 and a reverse opening type slider 1 in which the box pin 3 and the insert pin 4 can be inserted. The fastener chain 5 has a pair of right and left fastener stringers 6, 6. The fastener stringers 6, 6 comprise fastener tapes 8, 8, fastener elements 7, the box pin 3, the insert pin 4, stop ends 14, 14, and two sliders 1, 2. The fastener elements 7 are attached along one side edge of each of the fastener tapes 8, 8. The box pin 3 is attached adjacent to a top end of the fastener elements 7 of one of the fastener stringers 6, 6. The insert pin 4 is attached adjacent to a top end of the fastener elements 7 of the other fastener stringer 6. The stop ends 14, 14 are attached adjacent to bottom ends of the fastener elements 7, 7 of the fastener stringers 6, 6. The two sliders 1, 2 are capable of engaging or disengaging the fastener elements 7, 7.

Upon attachment of the box pin 3 and the insert pin 4, a space portion 11 is first formed by removing the fastener elements 7 from the fastener tape 8, and a reinforcement portion 10 is formed by bonding a resin film to the space portion 11. Then, the box pin 3 and the insert pin 4, which are made of resin, are fixed to the reinforcement portion 10 by injection molding.

The two sliders 1, 2 are disposed facing in opposite directions in a back and forth direction, and the fastener elements 7 pass through an interior of each of the respective sliders 1, 2. The two sliders 1, 2 have locking pawls 35, 35' that can be engaged with the fastener elements 7. The slider on one side is a reverse opening type slider 1 which constitutes a reverse opening type separable end stop with the box pin 3 and the insert pin 4. When the reverse opening type slider 1 is moved inward from a top end portion side of the fastener chain 5, that is, when the slider 1 is moved in a direction of leaving from a state in which it keeps contact with the box pin 3 and the insert pin 4, the fastener elements 7 in an engaged state can be separated. The other slider is an opening type slider 2 which can make contact with the end stop 14. The opening type slider 2 can engage the separated fastener elements 7 when the slider 2 is moved from an inside of the fastener chain 5 toward a bottom end portion side, that is, when the slider 2 is moved in a direction of approaching the end stop 14.

Figure 4:
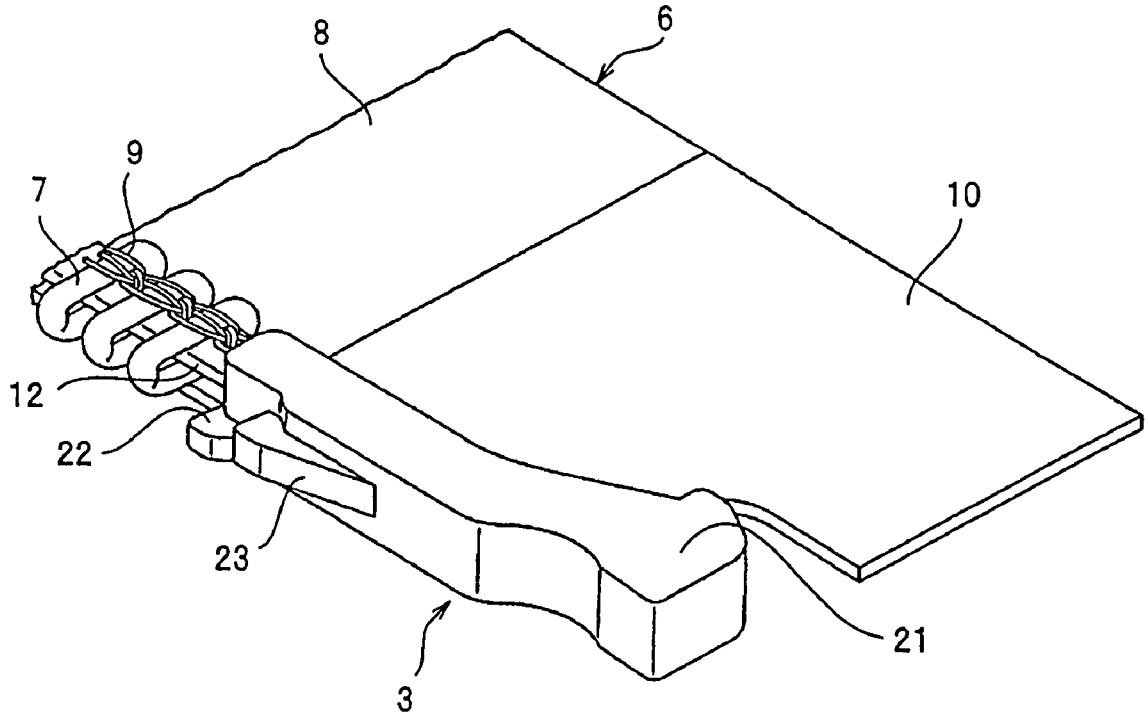
FIG. 4 is a perspective view of a box pin of the first embodiment.
Figure 5:
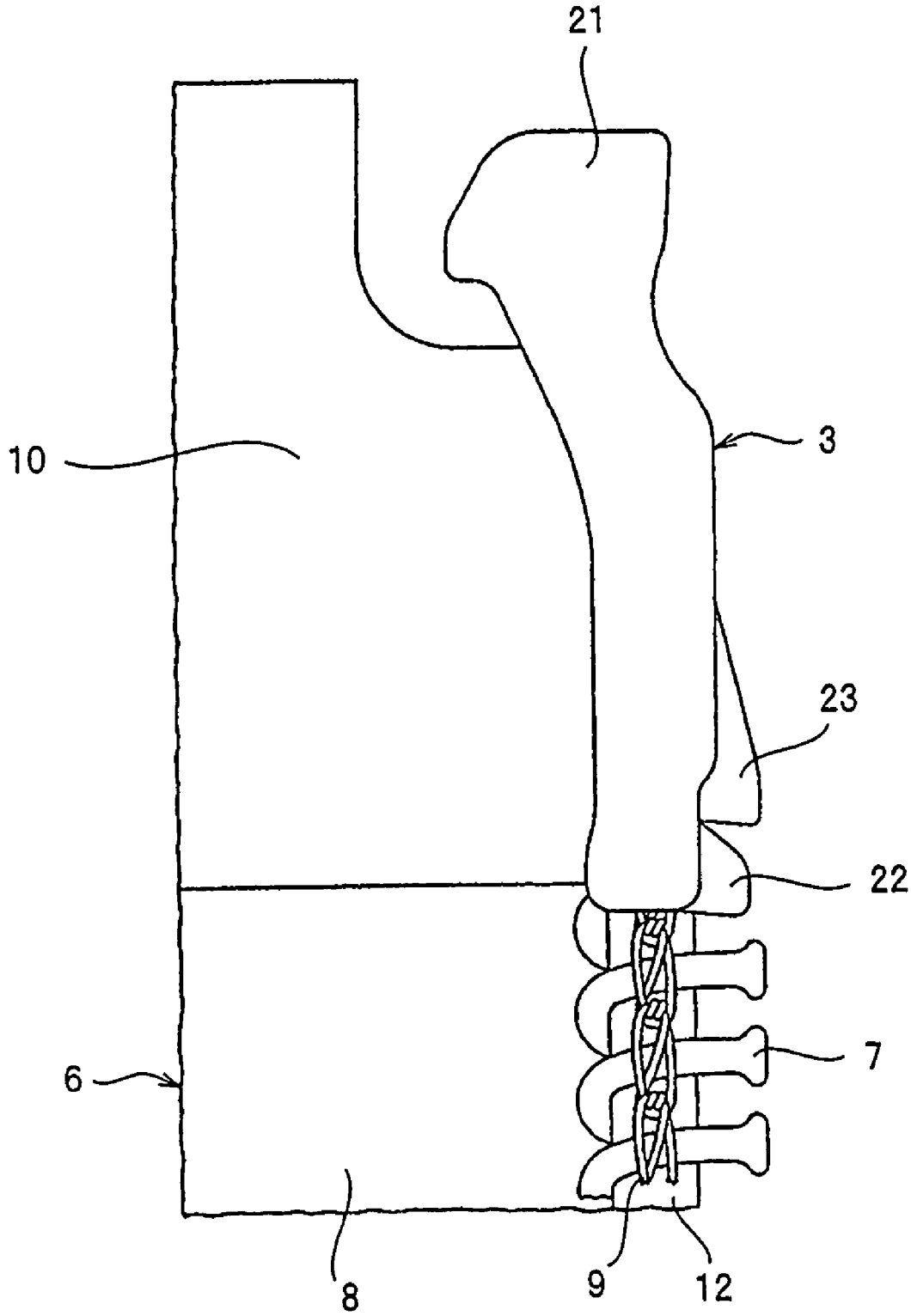
FIG. 5 is a front view of the box pin of the first embodiment.

As shown in FIGS. 4 and 5, the box pin 3 has an inside surface disposed inside of the fastener tape 8, that is, on a side in which the right and left fastener tapes 8 face each other and an outside surface disposed on an opposite side to the inside surface, that is, outside of the fastener tape 8. A front end of the box pin 3 has a hook portion 21, which is projected sideway in an L shape. More specifically, the hook portion 21 is projected inward of the fastener tape 8 from the inside surface, that is, toward an edge portion on the opposite side to an edge portion on which the fastener elements 7 are attached. The hook portion 21 comes into contact with a flange 31 provided on an upper blade plate 28 of the reverse opening type slider 1 so as to stop movement of the reverse opening type slider 1, thereby preventing the slider 1 from slipping out of the box pin 3.

Insertion pieces 22, 23 projecting outward of the fastener tape 8, that is, toward an insert pin 4 side are formed on the outside surface of the box pin 3, and the insertion pieces 22, 23 can be inserted and accommodated in accommodating portions 18, 19 formed in the insert pin. A first insertion piece 22 is provided at a proximal end of the box pin 3, that is, at an end portion on a side adjacent to the fastener element 7. The first insertion piece 22 is projected outward from the outside surface near a rear surface of the box pin 3 and can be inserted into a first accommodating portion 19 provided in the insert pin 4. Further, a second insertion piece 23 is provided at a position nearer the front end of the box pin 3 than the first insertion piece 22. The second insertion piece 23 is projected outward from the outside surface of the box pin 3 and can be inserted in a second accommodating portion 18 provided in the insert pin 4.

Figure 2:
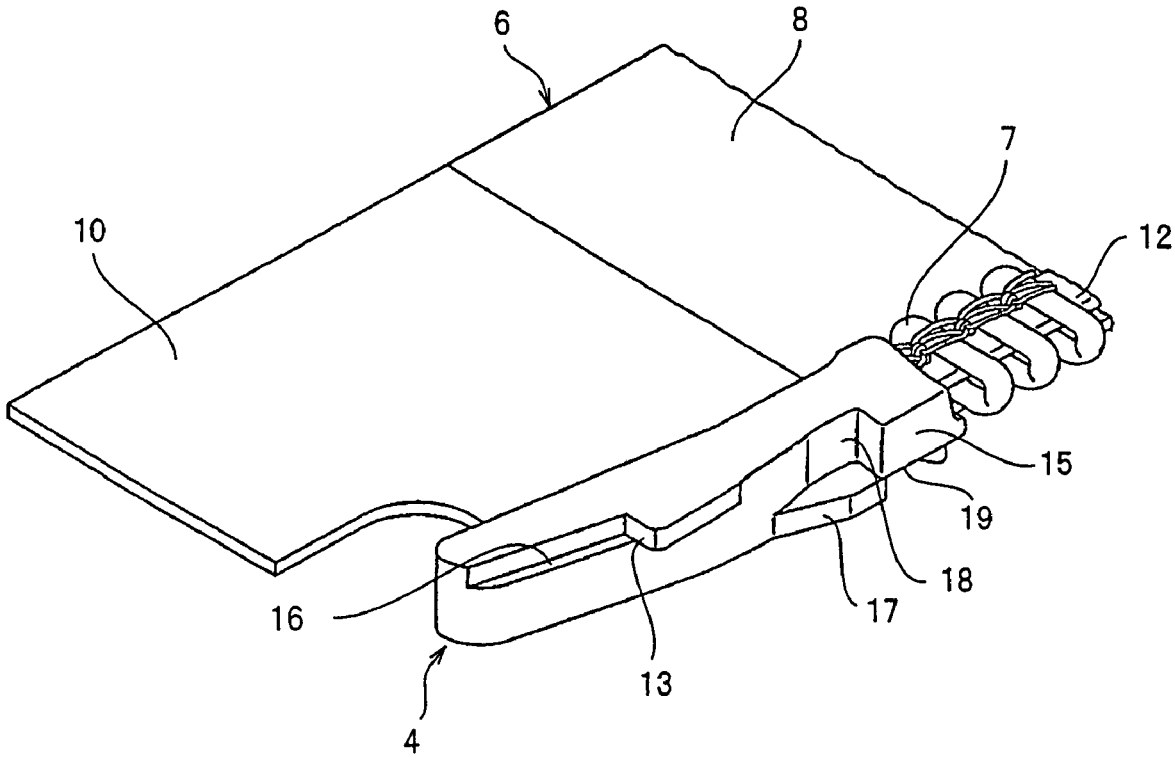
FIG. 2 is a perspective view of an insert pin of the first embodiment.
Figure 3:
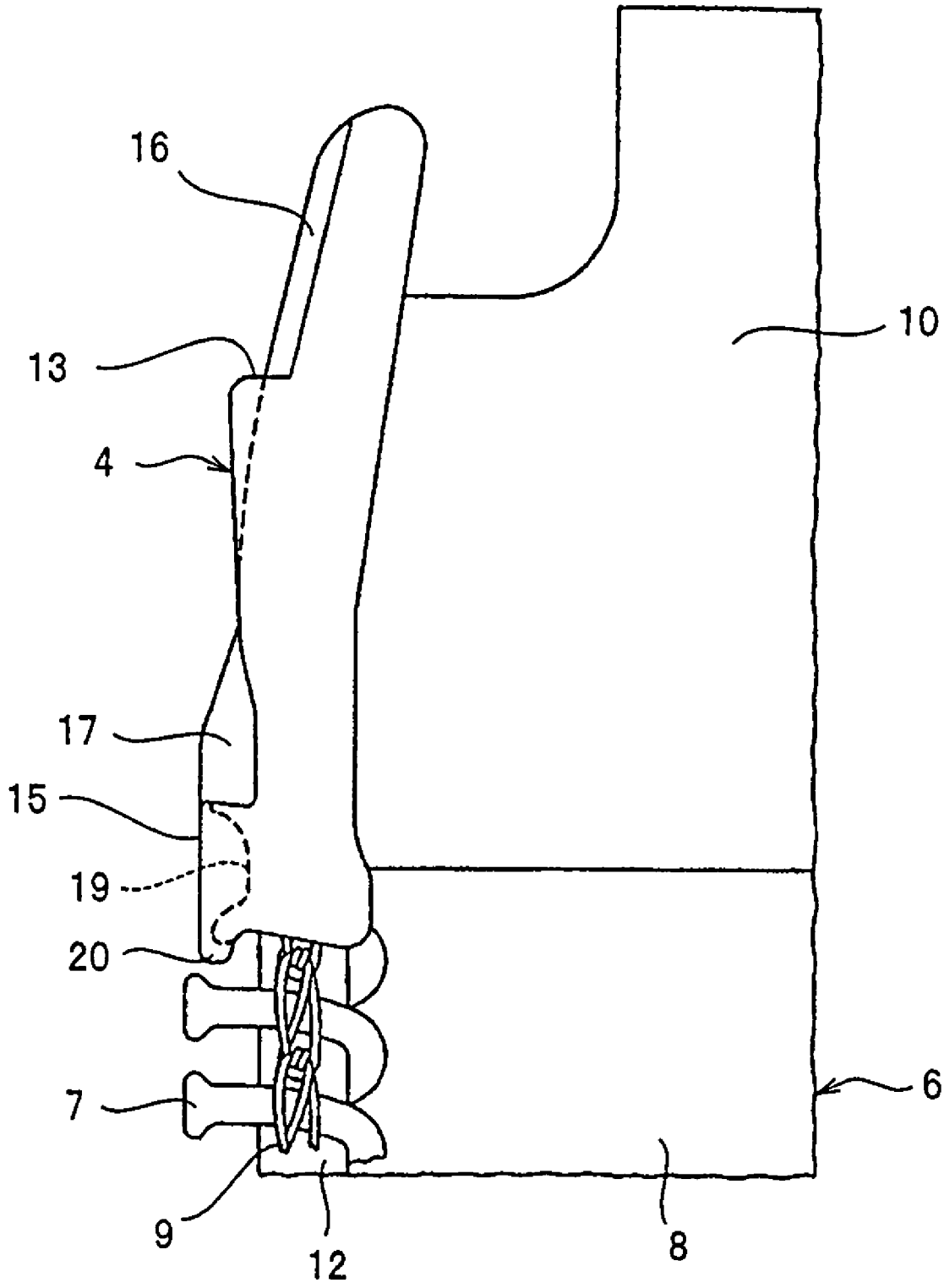
FIG. 3 is a front view of the insert pin of the first embodiment.

As shown in FIGS. 2 and 3, the insert pin 4 has an inside surface disposed inside of the fastener tape 8, that is, at a side in which the right and left fastener tapes 8 face each other, and an outside surface disposed on an opposite side to the inside surface, that is, outside of the fastener tape 8. The front end of the insert pin 4 is formed to slightly warp inward of the fastener tape 8 so as to facilitate insertion of the insert pin into the reverse opening type slider 1 and the opening type slider 2. The insert pin 4 has a contact portion 13 near a front end of the outside surface, that is, a surface facing the outside surface of the box pin 3. The contact portion 13 is projected toward the box pin 4 and can make contact with an end surface in a back and forth direction of the locking pawl 35 provided on the reverse opening type slider 1. Further, the insert pin 4 has a notch portion 16 from a proximal end of the contact portion 13 up to the front end of the insert pin 4. The notch portion 16 is produced by cutting out a boundary portion between a front surface of the insert pin 4 and the outside surface in a step-like fashion, in order to prevent a contact between the insert pin 4 and the locking pawl 35 when the insert pin 4 is inserted into the reverse opening type slider 1.

The contact portion 13 is a sheet-like body which is disposed at an intermediate position in the longitudinal direction of the insert pin 4 and is thinner than a thickness in the front and rear surface direction of the insert pin 4. The sheet-like body has a front surface continuous with the front surface of the insert pin 4, a side end surface connecting to the outside surface of the insert pin 4, and a front end surface extending in a direction intersecting with the side end surface. Thus, the sheet-like body provides a substantially triangular shape whose width dimension, that is, projection amount increases gradually from the proximal end side of the insert pin 4, that is, a side adjacent to the fastener elements 7 toward the front end side. Consequently, the contact portion 13 is so formed that its front end is wider than the proximal end, so that when the front end surface makes contact with the locking pawl 35, a wide contact area with the locking pawl 35 can be secured.

The outside surface of the insert pin 4 has supporting portions 15, 17 projecting outward of the fastener tape 8, that is, toward the box pin 3. The supporting portions 15, 17 have the accommodating portions 18, 19 capable of accommodating the insertion pieces 22, 23 of the box pin 3 on a front surface side or a rear surface side of the supporting portions 15, 17. A first supporting portion 15 which is projected outward from the outside surface of the insert pin 4 is provided on the proximal end of the insert pin 4, that is, an end portion on the side adjacent to the fastener element 7. On a rear surface side of the first supporting portion 15, there is provided a first accommodating portion 19 in a concave shape, in which the first insertion piece 22 of the box pin 3 is inserted. Further, a second supporting portion 17 which is projected outward from the outside surface of the insert pin 4 is provided nearer the front end of the insert pin 4 than the first supporting portion 15. On the front side of the second supporting portion 17, there is provided a second accommodating portion 18 in a concave shape, in which the second insertion piece 23 of the box pin 3 is inserted. Consequently, the first insertion piece 22 and the first supporting portion 15 overlap each other in a front and rear surface direction of the box pin 3 and the insert pin 4 while the second insertion piece 23 and the second supporting portion 17 overlap each other in the front and rear surface direction. As a result, even if a push-up force is applied to the box pin 3 and the insert pin 4 in the front and rear surface direction, the box pin 3 and the insert pin 4 are positioned without being deflected in the front and rear surface direction.

Figure 6:
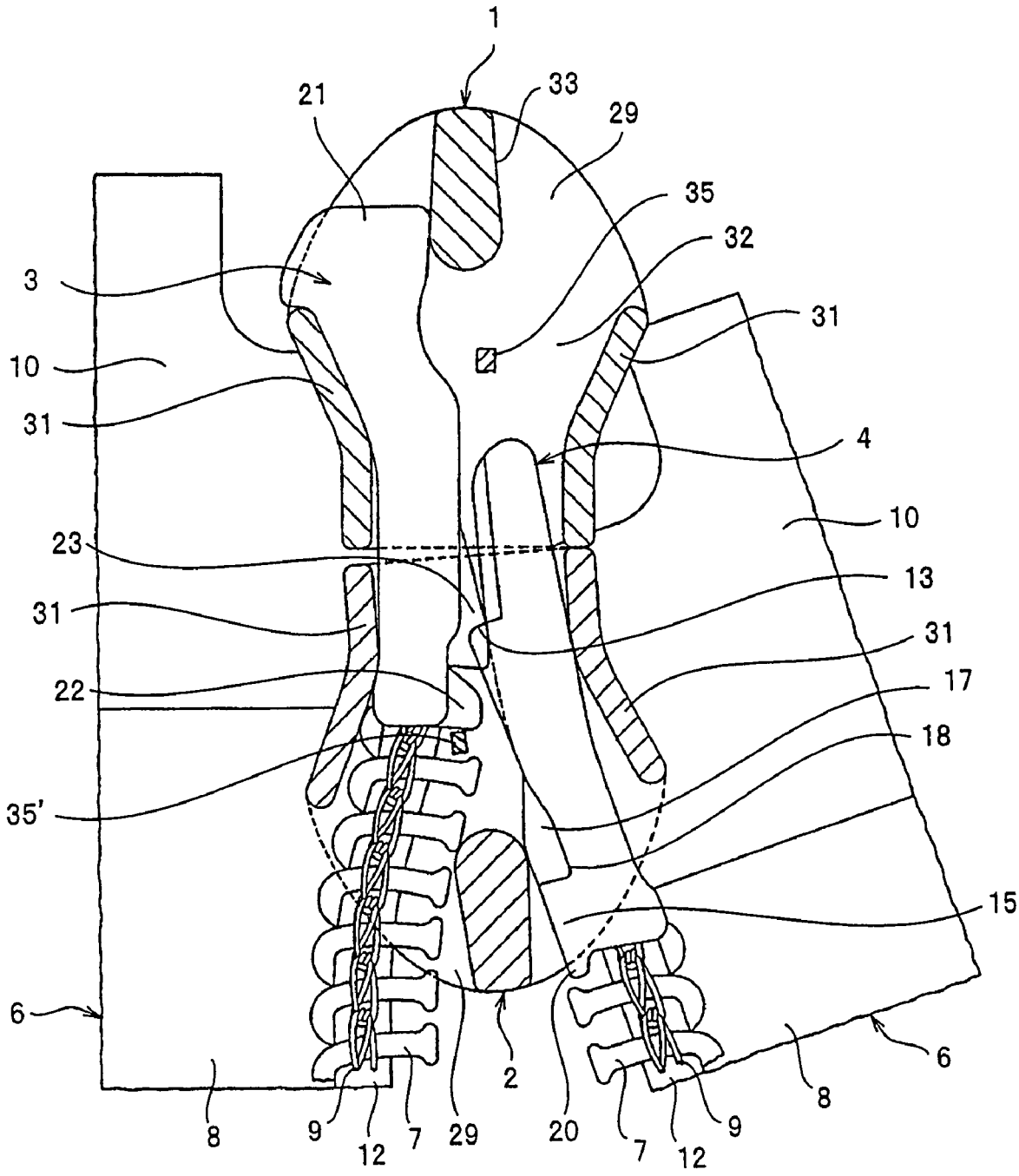
FIG. 6 is a sectional view of a state in which insertion of the insert pin into an opening type slider of the first embodiment is started.
Figure 9:
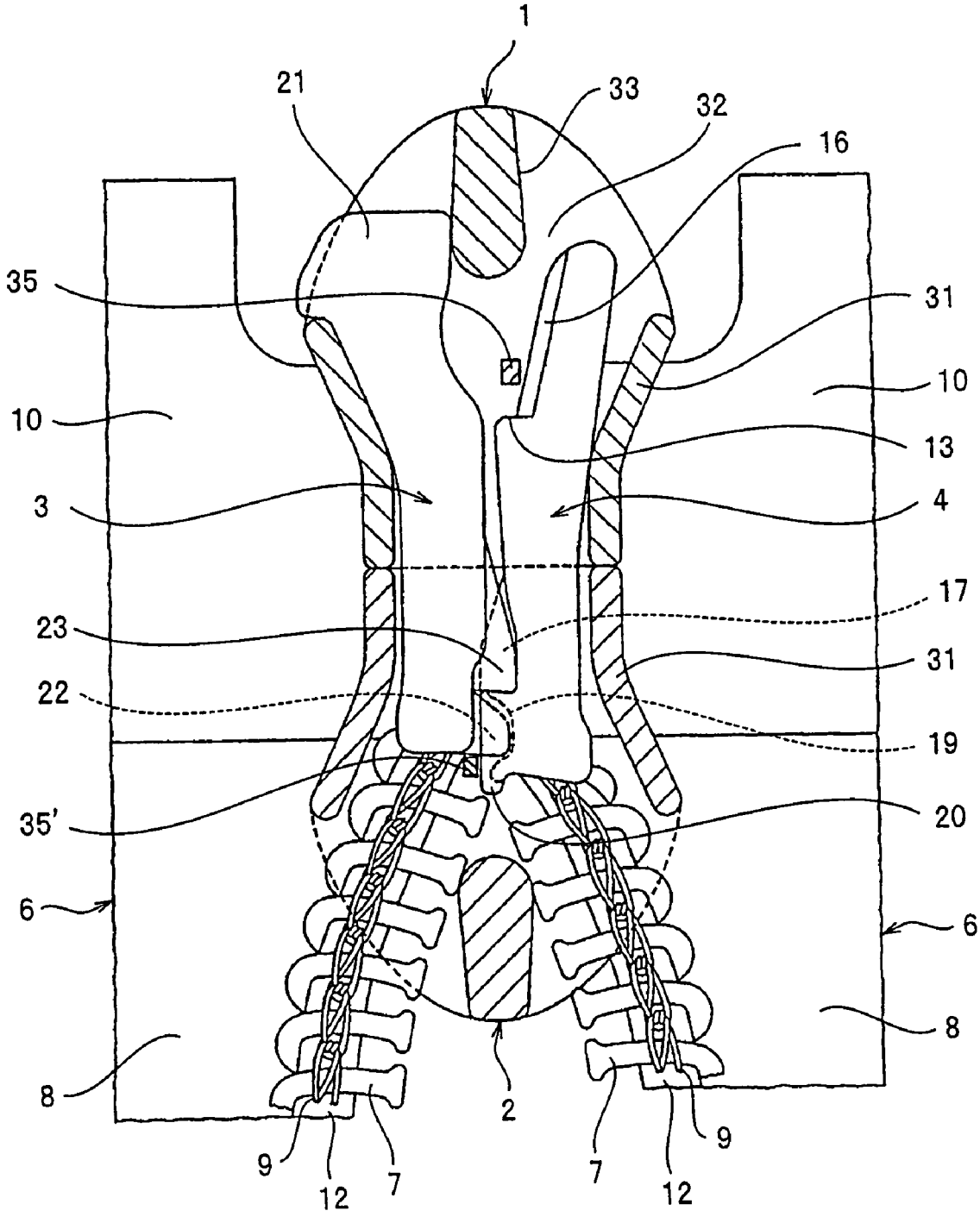
FIG. 9 is a sectional view when insertion of the insert pin to a reverse opening type slider and the opening type slider of the first embodiment is completed.

In the reverse opening type separable end stop of this slide fastener, as shown in FIG. 6, with the box pin 3 inserted already into the reverse opening type slider 1 and the opening type slider 2, the insert pin 4 is first inserted into the opening type slider 2 and then, into the reverse opening type slider 1. The insertion operation is completed in such a manner that, as shown in FIG. 9, the second insertion piece 23 of the box pin 3 is inserted and accommodated in the second accommodating portion 18 of the insert pin 4, the second insertion piece 23 is brought into contact with the first supporting portion 15 of the insertion pin 4 and the second insertion piece 22 is inserted and accommodated in the first accommodating portion 19. Next, when the opening type slider 2 is slid inward of the fastener chain 5 along the fastener elements 7, the fastener elements 7, 7 of the right and left fastener stringers 6, 6 engage each other, so that the fastener chain 5 is closed as shown in FIG. 10.

Figure 10:
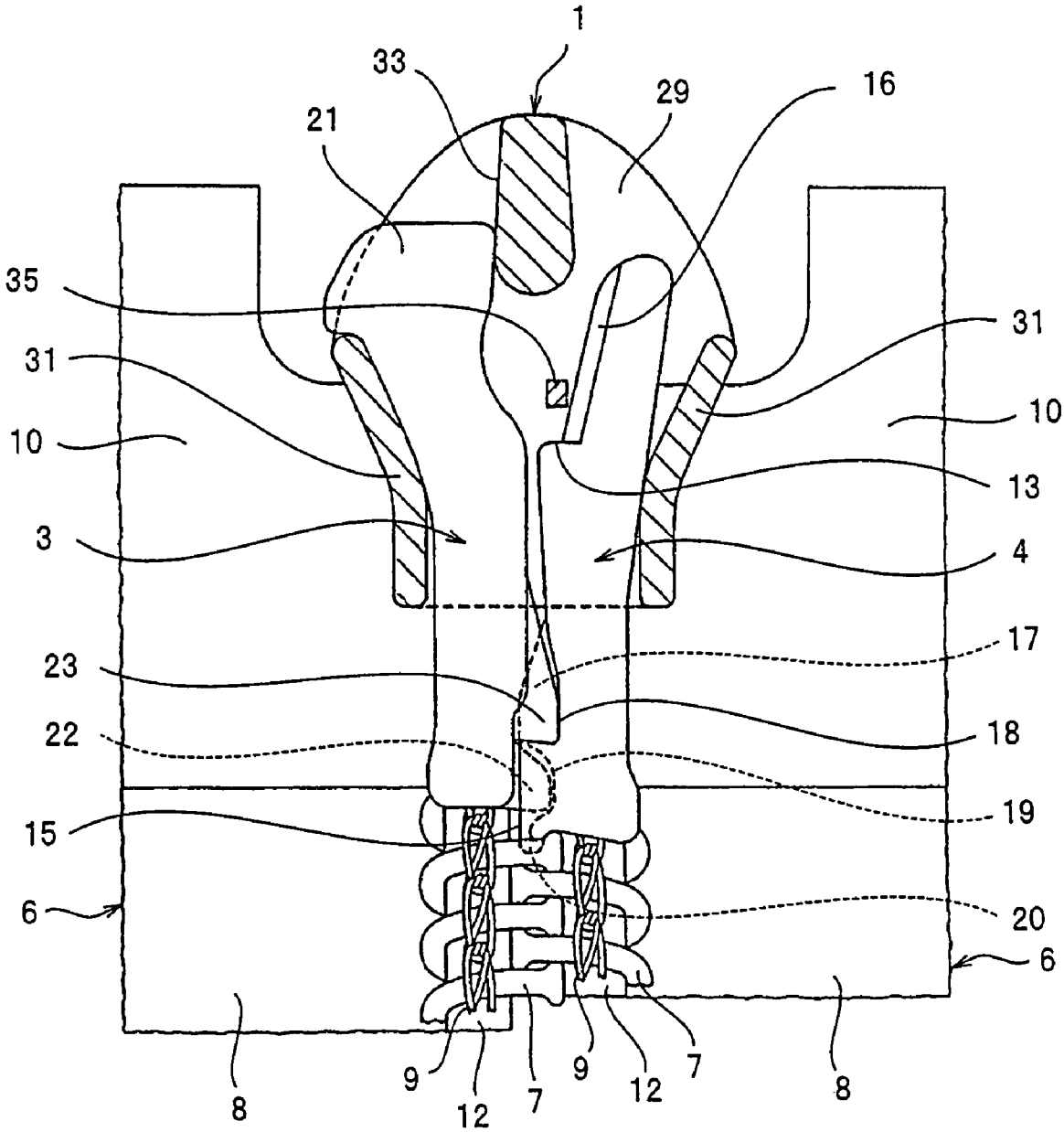
FIG. 10 is a sectional view showing a state in which the opening type slider is slid.
Figure 11:
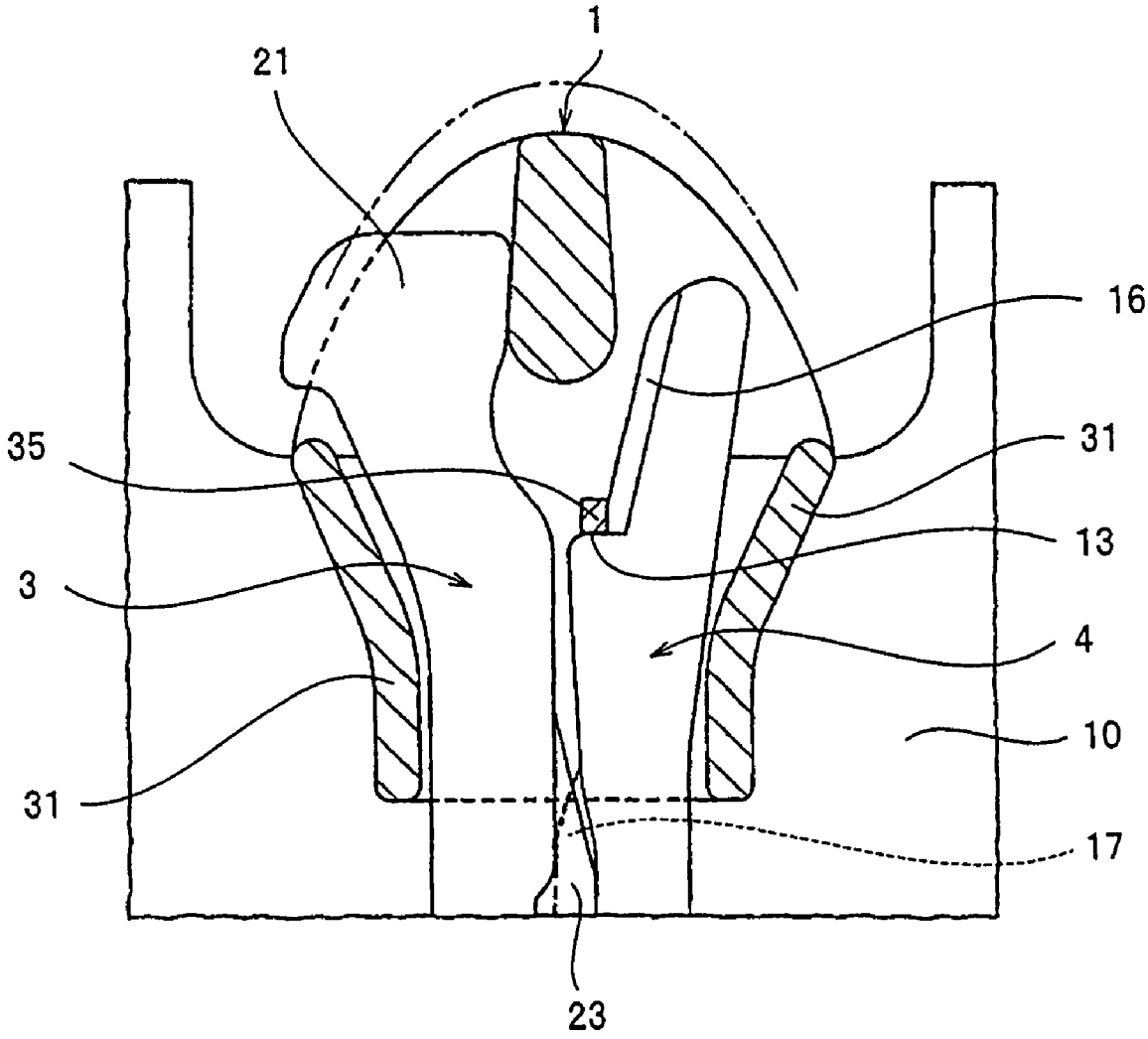
FIG. 11 is a sectional view of major portions showing a state in which the locking pawl and a contact portion make contact with each other when the reverse opening type slider is moved.
Figure 12:
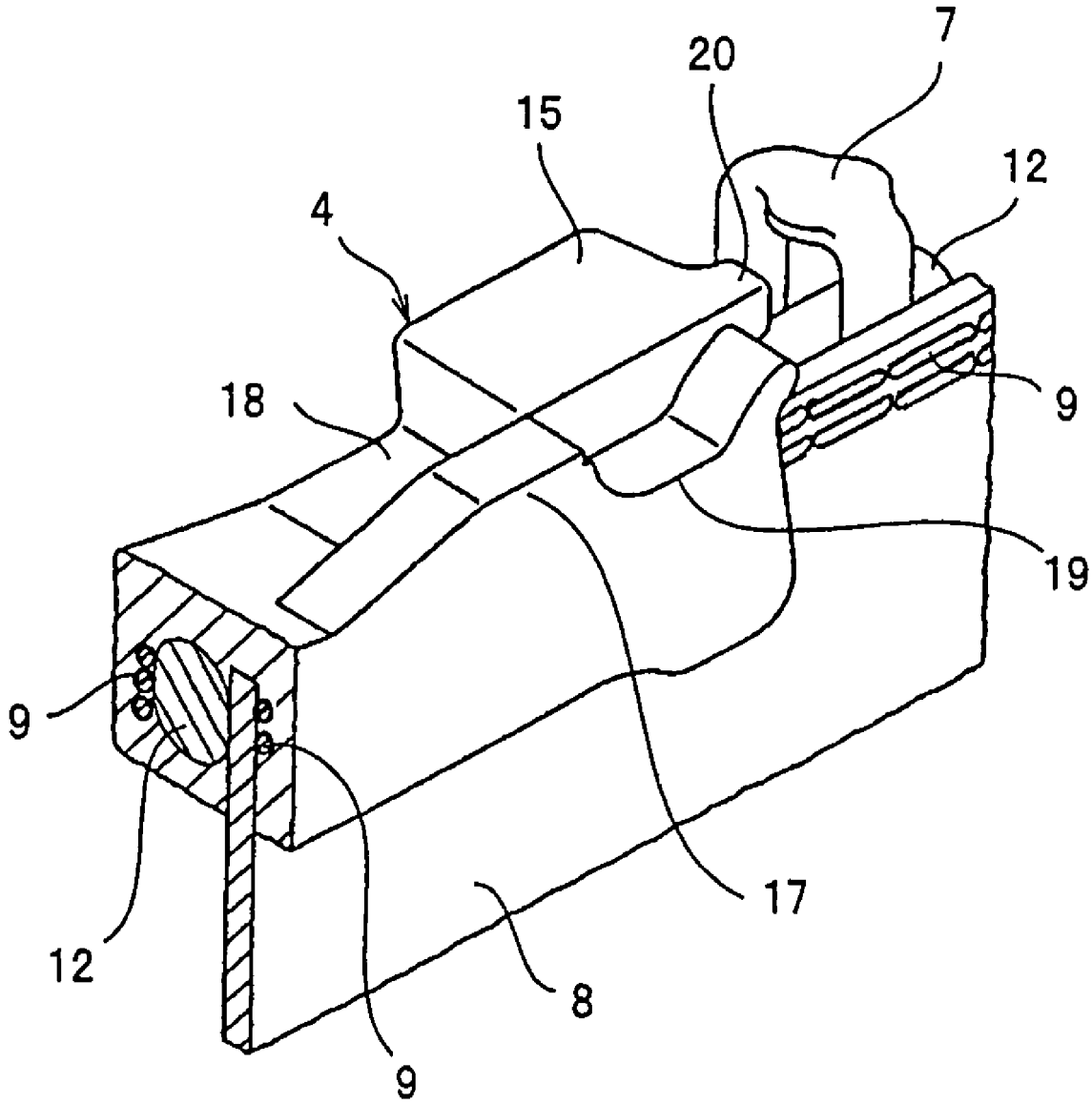
FIG. 12 is a partial sectional view showing a rear side of the insert pin.

When the fastener chain 5 is closed as shown in FIG. 10, the locking pawl 35 of the reverse opening type slider 1 makes contact with the contact portion 13 of the insert pin 4 as shown in FIG. 11 even if the reverse opening type slider 1 is about to move inward of the fastener chain 5 without any intentional operation, thereby preventing the reverse opening type slider 1 from moving inward of the fastener chain 5. Thus, the fastener elements 7, 7 of the right and left fastener stringers 6, 6 are never separated by the reverse opening type slider 1.

To release the closed fastener chain 5, the opening type slider 2 is first moved toward the revere opening type slider 1 so as to separate the fastener elements 7, 7 of the right and left fastener stringers 6, 6, and then, as shown in FIG. 6, the insert pin 4 is pulled out of the reverse opening type slider 1 and the opening type slider 2.

First Embodiment

A reverse opening type separable end stop of a slide fastener according to a first embodiment shown in FIGS. 1 to 12 is characterized in that an insert pin 4 includes a mechanism for restricting a reverse opening type slider 1 from moving inward of a fastener chain 5. The fastener chain 5 is produced as follows. A synthetic resin monofilament of polyamide, polyester or the like is wound into a coil or bent into a zigzag fashion so as to form linear fastener elements 7 continuous in the longitudinal direction of a fastener tape 8, and then, a core thread 12 is made to pass through an interior of the fastener elements 7 and sewed along one side edge in the longitudinal direction of the fastener tape 8 with a sewing yarn 9. Alternatively, a thermoplastic resin such as polyacetal, polyamide, polypropylene, and polybutylene terephthalate is used to form single unit fastener elements, by means of injection molding means, on an expanded portion formed along one side edge portion in the longitudinal direction of the fastener tape 8 at a predetermined interval in the longitudinal direction of the fastener tape 8 so as to form the fastener chain 5.

Space portions 11 are formed on each of a pair of right and left fastener stringers 6, 6 of the fastener chain 5 by removing the fastener elements 7 from the fastener tape 8 at a fixed interval. The space portions 11 are formed on both ends in the longitudinal direction of each fastener stringer 6. A resin made film, for example, a reinforcement tape formed of a thermoplastic elastomer film on its front surface and a hot-melt type adhesive agent on its rear surface, is fused with ultrasonic wave on each of the space portions 11 located at each end side so as to form a reinforcement portion 10. A box pin 3 is attached to the reinforcement portion 10 of one of the pair of right and left fastener stringers 6, 6 while an insert pin 4 is attached to the reinforcement portion 10 of the other fastener stringer 6. The box pin 3 and the insert pin 4 are molded by injection molding means using a thermoplastic resin such as polyacetal, polyamide, polypropylene, and polyethylene terephthalate, and fixed adjacent to one end in the row direction of the fastener elements 7. End stops 14 are attached to the space portions 11 at the other ends of the fastener stringers 6, 6. The end stops 14 are molded by injection molding means using a same thermoplastic resin as the box pin 3 and the insert pin 4 and fixed adjacent to the other ends in the row direction of the fastener elements 7, 7.

In the fastener chain 5 having the box pin 3, the insert pin 4 and the end stops 14 molded therein, as shown in FIG. 1, a reverse opening type slider 1 and an opening type slider 2 are inserted through the fastener elements 7. The reverse opening type slider 1 has its front end side in a sliding direction relative to the fastener elements 7 disposed to face the box pin 3 and the insert pin 4. The opening type slider 2 has its front end side in a direction opposite to the reverse opening type slider 1, that is, in the sliding direction, the front end side facing toward a side of the end stop 14. The respective sliders 1, 2 are molded by die casting means using metal such as aluminum alloy or zinc alloy. The reverse opening type slider 1 and the opening type slider 2 are mounted to the fastener stringer 6 on a side equipped with the box pin 3 such that they cannot slip out. Thus, the both sliders 1, 2 are blocked from slipping out of the fastener elements 7 by the box pin 3 attached to one end of the fastener elements 7 and the end stop 14 attached to the other end.

Figure 15:
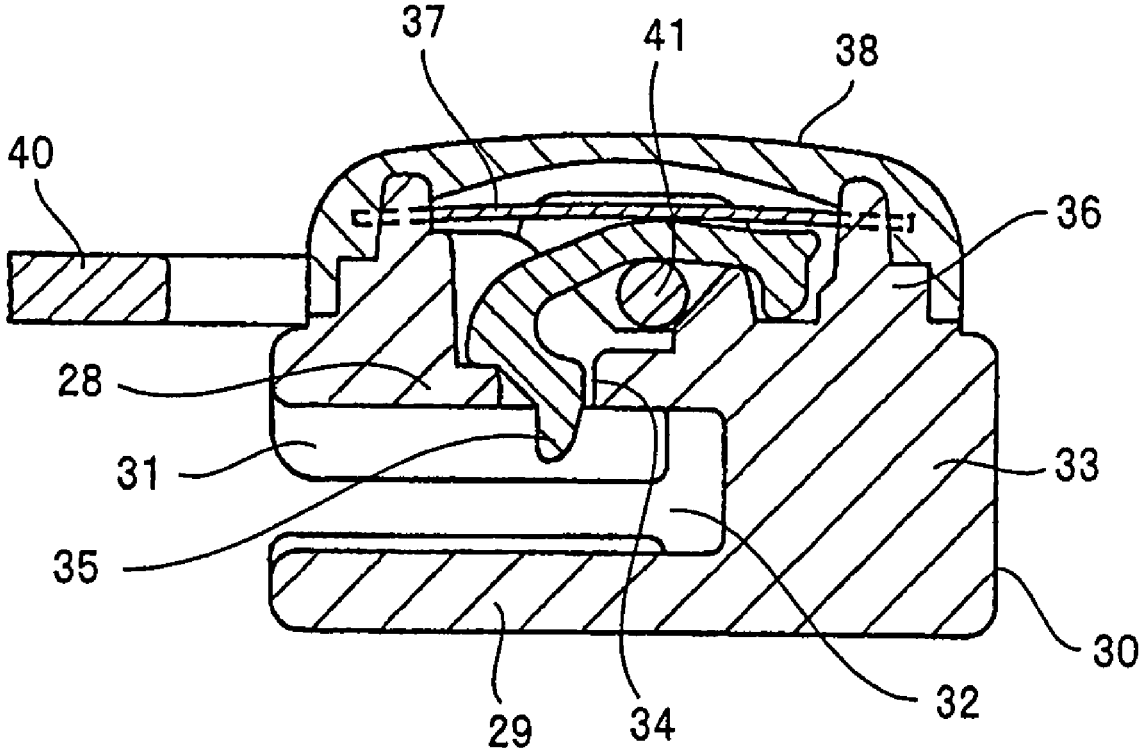
FIG. 15 is a sectional view of a slider to be used as a reverse opening type slider and an opening type slider.
Figure 16:
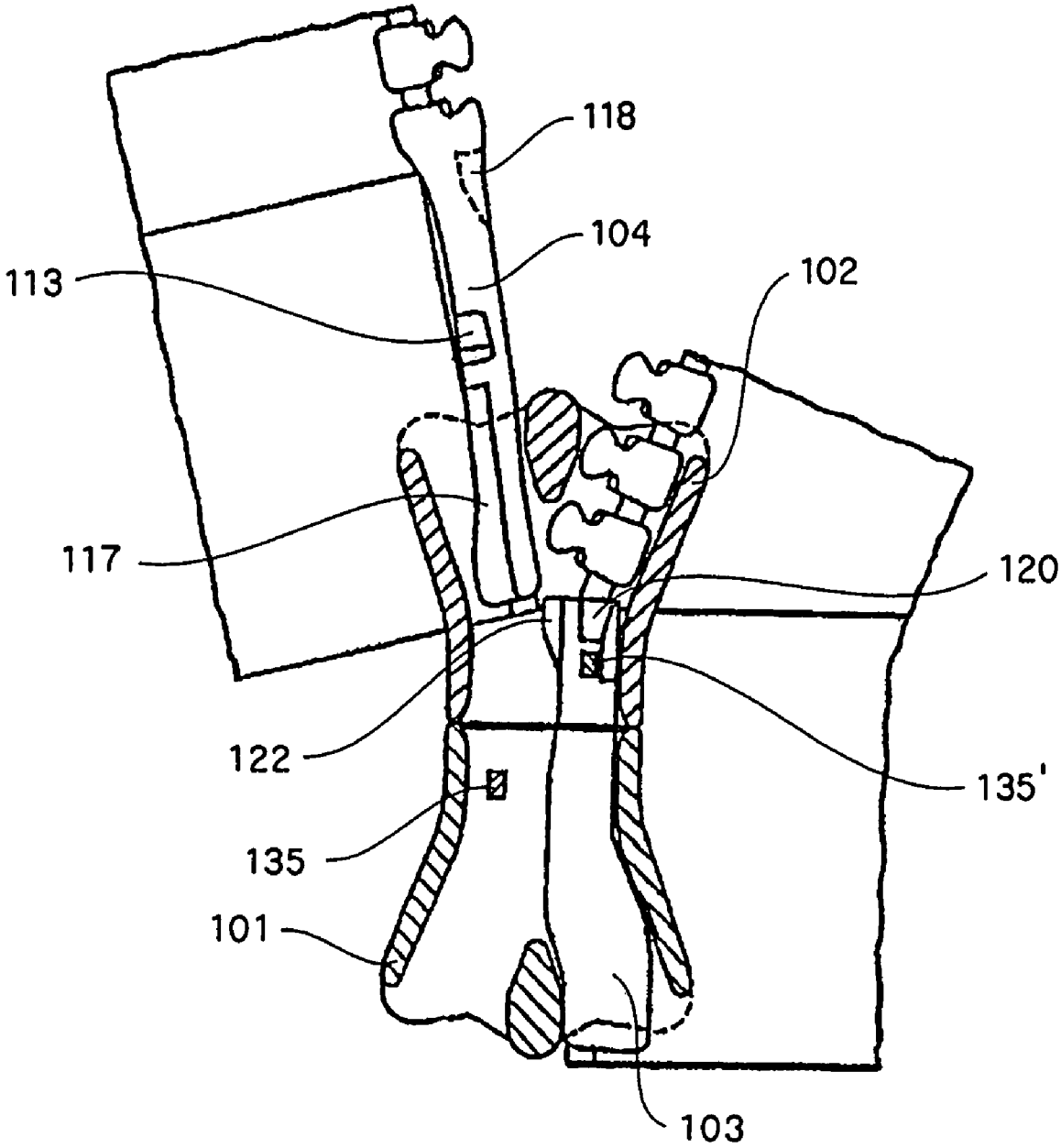
FIG. 16 PRIOR ART
FIG. 16 is a sectional view of a known reverse opening type separable end stop.

The reverse opening type slider 1 and the opening type slider 2 have a same configuration, for example, each are comprised of an upper blade plate 28 and a lower blade plate 29, a diamond 33, a slider body 30, a locking pawl 35, a leaf spring 37, a cover 38, and a pull tab 40 as shown in FIG. 15. The upper blade plate 28 and lower blade plate 29 are disposed in parallel with a gap in the vertical direction. The diamond 33 connects ends of the respective blade plates 28, 29. The slider body 30 has flanges 31 projecting from right and left side edges of at least one of the upper blade plate 28 and lower blade plate 29 toward the other one. The locking pawl 35 is disposed on a top surface of the upper blade plate 28 and can come out/retract with respect to an element guide passage 32 formed between the upper blade plate 28 and the lower blade plate 29 through a pawl hole 34 formed in the upper blade plate 28. The leaf spring 37 makes contact with a top surface of the locking pawl 35 to urge the locking pawl 35 elastically in a direction of projecting into the element guide passage 32. The cover 38 is fixed to an attaching post 36 standing from the top surface of the upper blade plate 28 to accommodate the locking pawl 35 and the leaf spring 37 therein. The pull tab 40 has a shaft portion 41 disposed between the slider body 30 and the locking pawl 35 and lifts up the locking pawl 35 and pulls out the locking pawl 35 from the element guide passage 32 by moving the shaft portion 41 upward. The respective sliders 1, 2 are disposed such that movements in the back and forth direction of the sliders 1, 2 are opposite to each other with respect to the fastener chain 5, so that the fastener elements 7 can be separated when the sliders are moved inward from an end portion of the fastener chain 5.

The box pin 3 and the insert pin 4 as the reverse opening type separable end stop will be described. The box pin 3 is entirely a substantial L-shaped rod body whose front end projects sideway as seen in a front view as shown in FIGS. 4 and 5 and is fixed along one side edge of the fastener tape 8 such that the box pin 3 adjoins one end in the row direction of the fastener elements 7. The reinforcement portion 10 on which the reinforcement tape is bonded is formed on a tape portion of the fastener tape 8 on which the box pin 3 is to be fixed. The reinforcement portion 10 reinforces the tape portion so as to prevent the tape portion from being deformed too much in order to facilitate handling of the reverse opening type separable end stop by gripping the tape portion in a vicinity of the box pin with the fingers when the reverse opening type separable end stop is operated.

The box pin 3 has a front surface, a rear surface, an inside surface located inside of the fastener tape 8 in the right-left direction perpendicular to the front and rear surface direction of the box pin 3, and an outside surface located outside of the fastener tape 8. The front end of the box pin 3 is provided with an L-shaped hook portion 21 which is projected from the inside surface inward of the fastener tape 8, that is, toward the opposite side to a side in which the outside surface exists. A width in the right-left direction of the front end of the box pin 3 containing the hook portion 21 is formed larger than a width of the proximal end of the box pin 3. Consequently, when the front end of the box pin 3 is about to enter the element guide passage 32 of the reverse opening type slider 1, the hook portion 21 comes into contact with a front end of a flange 31 formed on the upper blade plate 28 of the reverse opening type slider 1 while the outside surface of the box pin 3 comes into contact with a side surface of the diamond 33 of the reverse opening type slider 1, as shown in FIG. 6. With this configuration, the front end of the box pin 3 cannot pass through an interior of the element guide passage 32, thereby preventing the reverse opening type slider 1 from slipping out of the box pin 3.

The proximal end of the box pin 3 is located on an opposite side in a longitudinal direction of the box pin 3 with respect to the front end of the box pin 3 such that the proximal end of the box pin 3 adjoins one end in a row direction of the fastener elements 7. A first insertion piece 22, which is projected from the outside surface of the box pin 3 outward of the fastener tape 8, that is, toward the opposite side to a side in which the inside surface exists, is formed at the proximal end of the box pin 3. The first insertion piece 22 is a sheet body thinner than a thickness in the front and rear surface direction of the box pin 3. The first insertion piece 22 has a rear surface continuous with the rear surface of the box pin 3, and can be accommodated in a first accommodating portion 19 in a concave shape provided in the insert pin 4. A second insertion piece 23, which is projected outward of the fastener tape 8 from the outside surface of the box pin 3 is formed nearer the front end of the box pin 3 than the first insertion piece 22. The second insertion piece 23 is a sheet body thinner than the thickness in the front and rear surface direction of the box pin 3. The second insertion piece 23 is disposed in a center in the front and rear surface direction of the box pin 3 and can be accommodated in a second accommodating portion 18 in a concave shape provided in the insert pin 4. Since the respective insertion pieces 22, 23 are inserted into the respective accommodating portions 19, 18, the box pin 3 and the insert pin 4 can be kept stably kept without being deflected when the box pin 3 and the insert pin 4 are inserted into the reverse opening type slider 1.

As shown in FIGS. 2 and 3, the insert pin 4 is fixed along one side edge of the fastener tape 8 such that the insert pin 4 adjoins one end in the row direction of the fastener elements 7 at one end in the longitudinal direction of the fastener stringer 6. The insert pin 4 is curved into an arc with its front end being directed inward of the fastener tape 8, that is, toward an edge portion side of the fastener tape 8 on the opposite side to an edge portion provided with the fastener elements 7. Thus, the insert pin is formed in a shape of being slightly warped in a front view. The reinforcement portion 10 on which the reinforcement tape is bonded is formed at a tape portion of the fastener tape 8 on which the insert pin 4 is to be fixed like the box pin 3, thereby reinforcing the tape portion in a vicinity of the insert pin to prevent the tape portion from being deformed too much.

The insert pin 4 has a front surface, a rear surface, an inside surface located inside of the fastener tape 8 in the right-left direction perpendicular to the front and rear surface direction of the insert pin 4, and an outside surface located outside of the fastener tape 8. On the outside surface of the insert pin 4, that is, a surface facing the box pin 3, a contact portion 13 which is projected outward of the fastener tape 8 is formed at a position near the front end with respect to the center in the longitudinal direction of the insert pin 4. The contact portion 13 is a sheet body thinner than the thickness in the front and rear surface direction of the insert pin 4, and provides a substantially triangular shape as seen in its front view. The contact portion 13 has a side end surface extending from the proximal end side of the insert pin 4 toward the front end side in the longitudinal direction of the insert pin 4, and a front end surface intersecting with the side end surface and extending in the right-left direction perpendicular to the longitudinal direction of the insert pin 4. As shown in FIG. 15, the front end surface of the contact portion 13 comes into contact with a rear end surface in the back and forth direction of the slider 1 at the locking pawl 35 projected into the interior of the element guide passage 32 from the upper blade plate 28 of the reverse opening type slider 1 so as to stop movement of the reverse opening type slider 1.

The contact portion 13 is disposed at a position near a front surface side in the front and rear surface direction of the insert pin 4. The contact portion 13 is deflected from the first insertion piece 22 and the second insertion piece 23 of the box pin 3 in their projection positions in the front and rear surface direction of the box pin 3 and insert pin 4. The contact portion 13 is located near the front surface side, the first insertion piece 22 is located near a rear surface side, the second insertion piece 23 is located between the contact portion 13 and the first insertion piece 22. Consequently, when the insert pin 4 is inserted into the reverse opening type slider 1, so that when the insert pin 4 and the box pin 3 are located nearby, the insert pin 4 is blocked from making contact with the first insertion piece 22 and the second insertion piece 23 of the box pin 3.

The insert pin 4 has a notch portion 16 formed from the proximal portion of the contact portion 13, that is, from a corner portion in which the front end surface of the contact portion 13 and the outside surface of the insert pin 4 intersect up to the front end of the insert pin 4. The notch portion 16 is produced by cutting out a portion in which the front surface and the outside surface of the insert pin 4 intersect into a step-like fashion. The locking pawl 35 is projected into the element guide passage 32 and its projection position is located in an insertion passage of the insert pin 4 inserted into the element guide passage 32. With this configuration, when the insert pin 4 is inserted into the element guide passage 32, the locking pawl 35 invades into the notch portion 16 during an insertion process so as to form a space for avoiding a contact between the insert pin 4 and the locking pawl 35.

The proximal end of the insert pin 4 is located on an opposite side in the longitudinal direction of the insert pin 4 with respect to the front end of the insert pin 4 and adjoins one end portion in the row direction of the fastener elements 7. A first supporting portion 15 is formed at the proximal end of the insert pin 4 such that the first supporting portion 15 is projected from the outside surface of the insert pin 4 outward of the fastener tape 8, that is, toward an opposite side to the side in which the inside surface exists. The first supporting portion 15 is a sheet body thinner than the thickness in the front and rear surface direction of the insert pin 4, which has a surface continuous with the front surface of the insert pin 4. A first accommodating portion 19 in a concave shape is formed in a rear surface of the first supporting portion 15 such that the first accommodating portion 19 is open outward of the fastener tape 8, that is, toward the outside surface of the box pin 3. When the first insertion piece 22 of the box pin 3 is inserted into the first accommodating portion 19 of the insert pin 4, the first supporting portion 15 and the first insertion piece 22 can overlap each other in the front and rear surface direction of the box pin 3 and the insert pin 4. An engaging projection 20 which projects toward a side of the fastener elements 7 adjacent to the insert pin 4 is formed at a front end of the first supporting portion 15. The engaging projection 20 can engage the fastener element 7 of the fastener stringer 6 on the side provided with the box pin 3 when the fastener elements 7, 7 of the right and left fastener stringers 6, 6 are coupled with each other.

A second supporting portion 17 which is projected outward of the fastener tape 8 from the outside surface of the insert pin 4 is formed at a position nearer the front end of the insert pin 4 than the first supporting portion 15 of the insert pin 4. The second supporting portion 17 is a sheet body thinner than the thickness in the front and rear surface direction of the insert pin 4, and is disposed at a position near the rear surface in the front and rear surface direction of the insert pin 4. A second accommodating portion 18 in a concave shape which is open outward of the fastener tape 8, that is, toward the outside surface of the box pin 3 is formed on a top surface of the second supporting portion 17. When the second insertion piece 23 of the box pin 3 is inserted into the second accommodating portion 18 of the insert pin 4, the second supporting portion 17 and the second insertion piece 23 can overlap each other in the front and rear surface direction of the box pin 3 and the insert pin 4. The second supporting portion 17 has a slope face which is extended from its front end toward the outside surface of the insert pin 4 and inclined downward toward the front end side of the insert pin 4. Consequently, even if the second supporting portion 17 comes into contact with the diamond 33 of the opening type slider 2 when the insert pin 4 is inserted into the opening type slider 2, the slope face of the second supporting portion 17 moves while sliding on a side surface of the diamond 33, so that the insert pin 4 can be inserted smoothly into the opening type slider 2.

Figure 7:
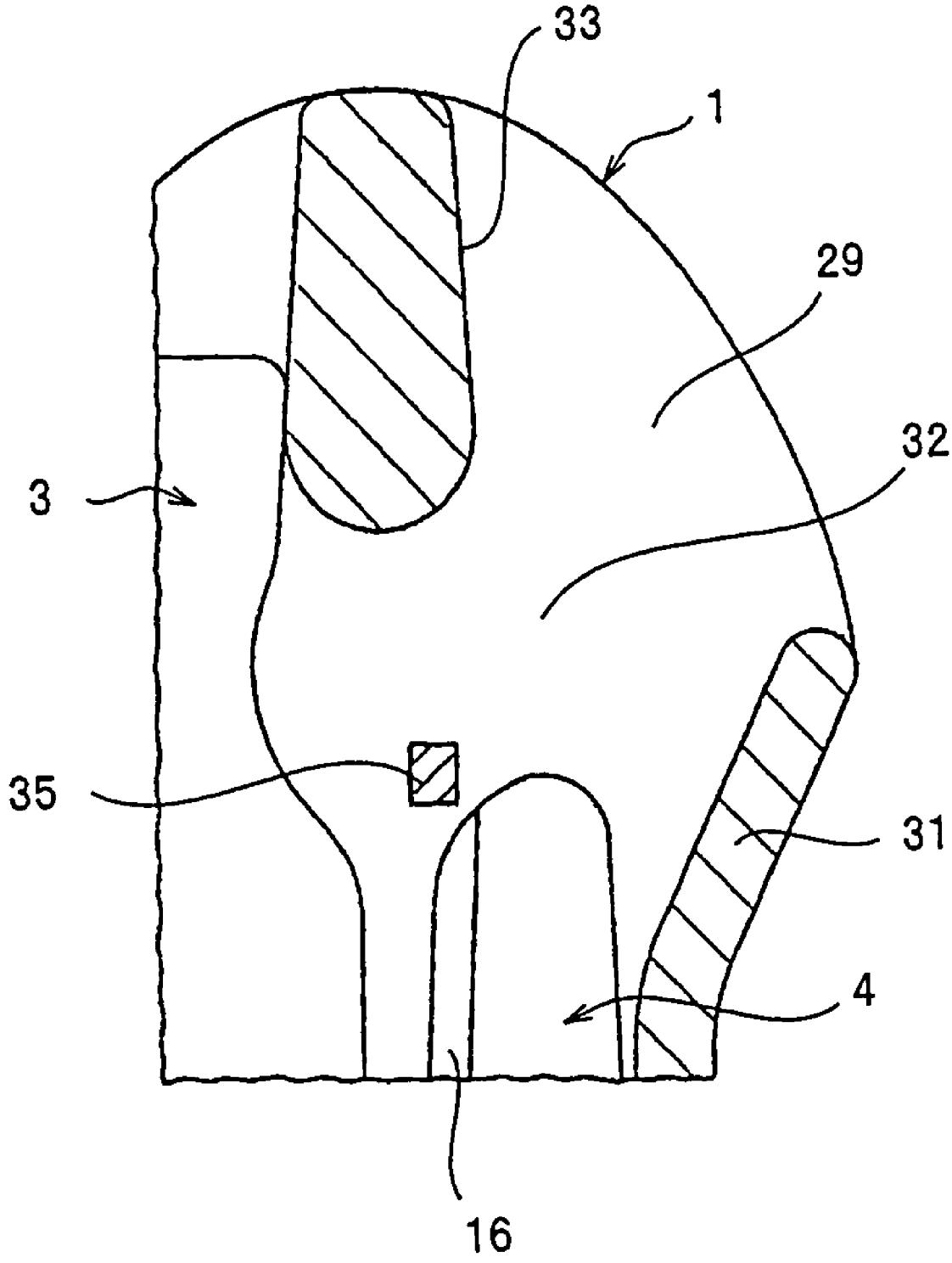
FIG. 7 is a sectional view of major portions showing a state in which the insert pin of the first embodiment approaches a locking pawl.
Figure 8:
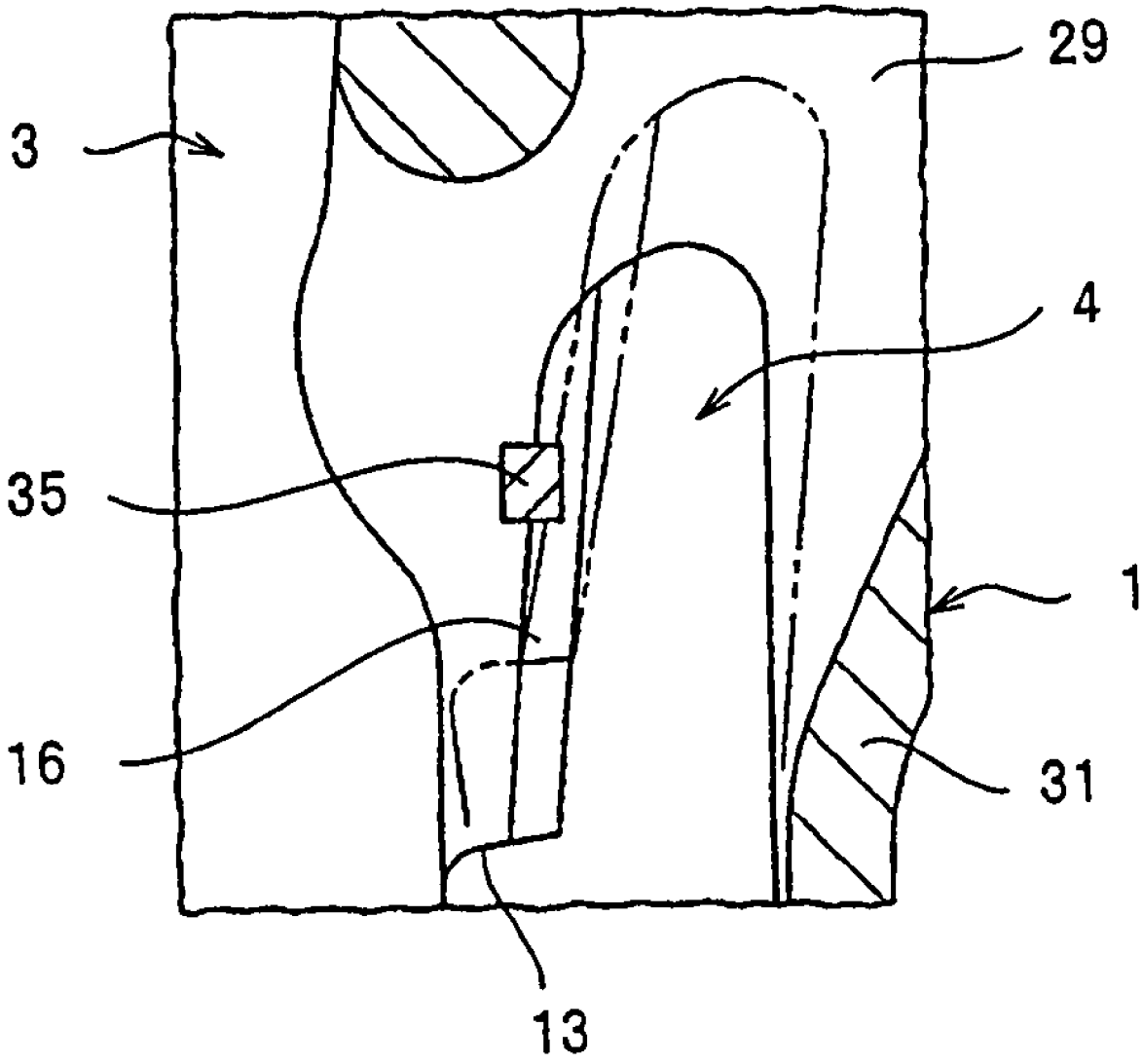
FIG. 8 is a sectional view of major portions showing a state in which the insert pin of the first embodiment is moving while avoiding a contact with the locking pawl.

An action of the reverse opening type separable end stop of the slide fastener will be described. As shown in FIG. 6, when inserting the insert pin 4 into the reverse opening type slider 1 and the opening type slider 2 in which the box pin 3 is inserted, the insert pin 4 is inserted into the element guide passage 32 in the opening type slider 2 from the front end side of the slider 2 and next, inserted into the element guide passage 32 in the reverse opening type slider 1 from the rear end side of the slider 1. As shown in FIGS. 7 and 8, the insert pin 4 inserted into the element guide passage 32 in the reverse opening type slider 1 is moved toward the front end side of the reverse opening type slider 1 with the front end of the locking pawl 35 of the slider 1 invading in the notch portion 16 formed in the front end of the insert pin 4. Thereafter, as shown in FIG. 9, the second insertion piece 23 of the box pin 3 and the first supporting portion 15 of the insert pin 4 come into contact with each other so as to complete insertion of the insert pin 4. A locking pawl 35' provided on the opening type slider 2 is projected into the element guide passage 32 between the box pin 3 and the fastener element 7 adjacent to the box pin 3. Consequently, when the opening type slider 2 is about to move in the direction of leaving the reverse opening type slider 1, the locking pawl 35' comes into contact with the fastener element 7, thereby stopping the movement of the opening type slider 2.

When the pull tab 40 of the opening type slider 2 is operated, the locking pawl 35' of the slider 2 is lifted up to leave the element guide passage 32, the opening type slider 2 is moved inward of the fastener chain 5, that is, in a direction of leaving the reverse opening type separable end stop comprised of the box pin 3, the insert pin 4 and the reverse opening type slider 1. The opening type slider 2 is slid along the fastener elements 7, 7 so as to couple the fastener elements 7, 7 of the right and left fastener stringers 6, 6, thereby closing the fastener chain 5 as shown in FIG. 10.

The first supporting portion 15 of the insert pin 4 is located on a front surface side of the first insertion piece 22 of the box pin 3, and the second insertion piece 23 of the box pin 3 is located on a front surface side of the second supporting portion 17 of the insert pin 4, so that the two insertion pieces of the box pin 3 and the two supporting portions of the insert pin 4 overlap with a different positional relationship of the front and rear surfaces. For this reason, even if a push-up force is applied to the box pin 3 and the insert pin 4 from any direction from the front surface or the rear surface, postures of the box pin 3 and insert pin 4 are not deflected. Thus, there never occurs such a phenomenon that a large gap is generated between the box pin 3 and the insert pin 4 by the push-up force, so that separation of a coupled state is induced with respect to the fastener elements 7 adjacent to the box pin 3 and the insert pin 4.

The engaging projection 20 formed on the first supporting portion 15 of the insert pin 4 engages the fastener element 7 adjacent to the box pin 3, so that even if a push-up force in the front and rear surface direction is applied to a portion between the box pin 3 or the insert pin 4 and the fastener element 7, a posture of this portion is not deflected. Accordingly, there never occurs such a phenomenon that a large gap is generated between the box pin 3 or the insert pin 4 and the fastener element 7 by the push-up force so that separation of the coupled state is induced with respect to the fastener elements 7 from this portion.

Assuming that after the fastener chain 5 is closed with the opening type slider 2, the reverse opening type slider 1 is moved inward of the fastener chain 5 from a position indicated with a phantom line as shown in FIG. 11, that is, from a state in which the front end of the flange 31 of the reverse opening type slider 1 keeps contact with the hook portion 21 of the box pin 3 without any intentional operation, namely, the front end of the flange 31 departs from the hook portion 21 of the box pin 3. In this case, the contact portion 13 of the insert pin 4 comes into contact with the locking pawl 35 of the reverse opening type slider 1, thereby stopping the movement of the reverse opening type slider 1.

To separate the closed fastener chain 5 to the right and left fastener stringers 6, 6, the opening type slider 2 is slid toward the separable end stop along the fastener elements 7 so as to separate the fastener elements 7, 7 of the right and left fastener stringers 6, 6. Next, the opening type slider 2 is moved up to a position in which the slider 2 makes contact with the reverse opening type slider 1 with the opening type slider 2 being mounted on the box pin 3 and the insert pin 4. Then, as show in FIG. 6, when the insert pin 4 is pulled out of the respective element guide passages 32, 32 in the reverse opening type slider 1 and the opening type slider 2, the fastener stringer 6 on the insert pin 4 side and the fastener stringer 6 on the box pin 3 side can be separated from each other.

Second Embodiment

Figure 13:
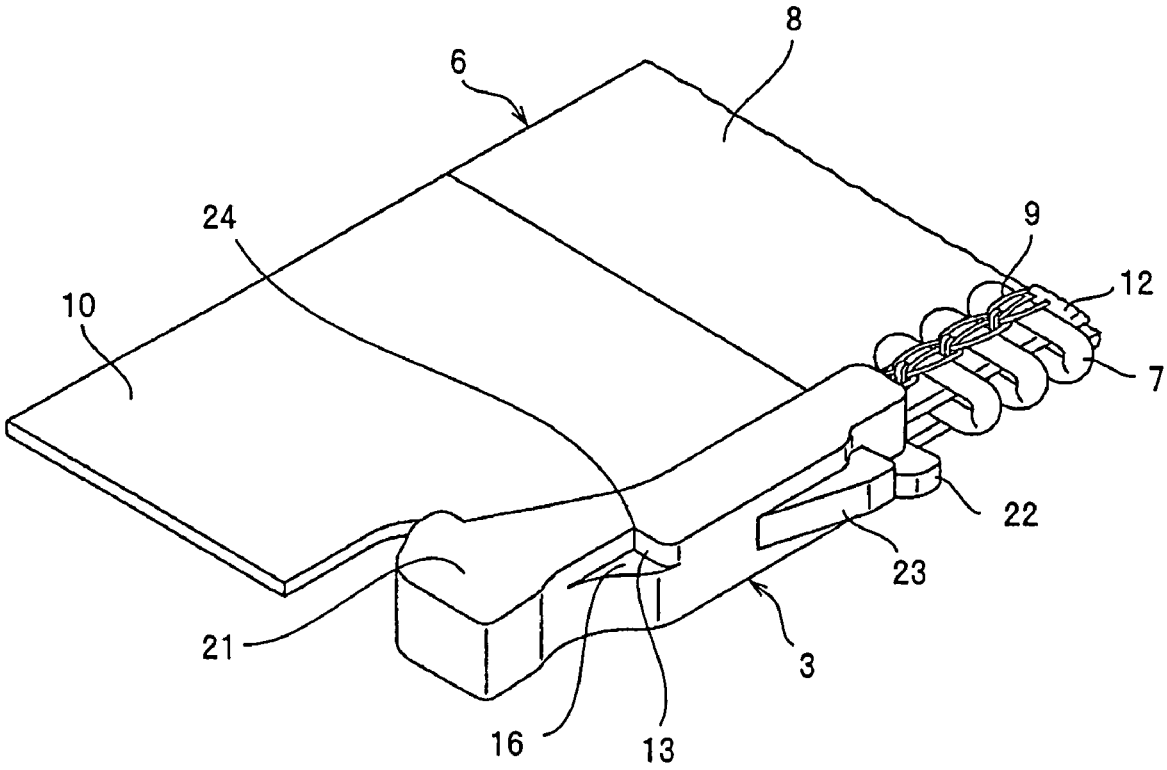
FIG. 13 is a perspective view of a box pin according to a second embodiment.
Figure 14:
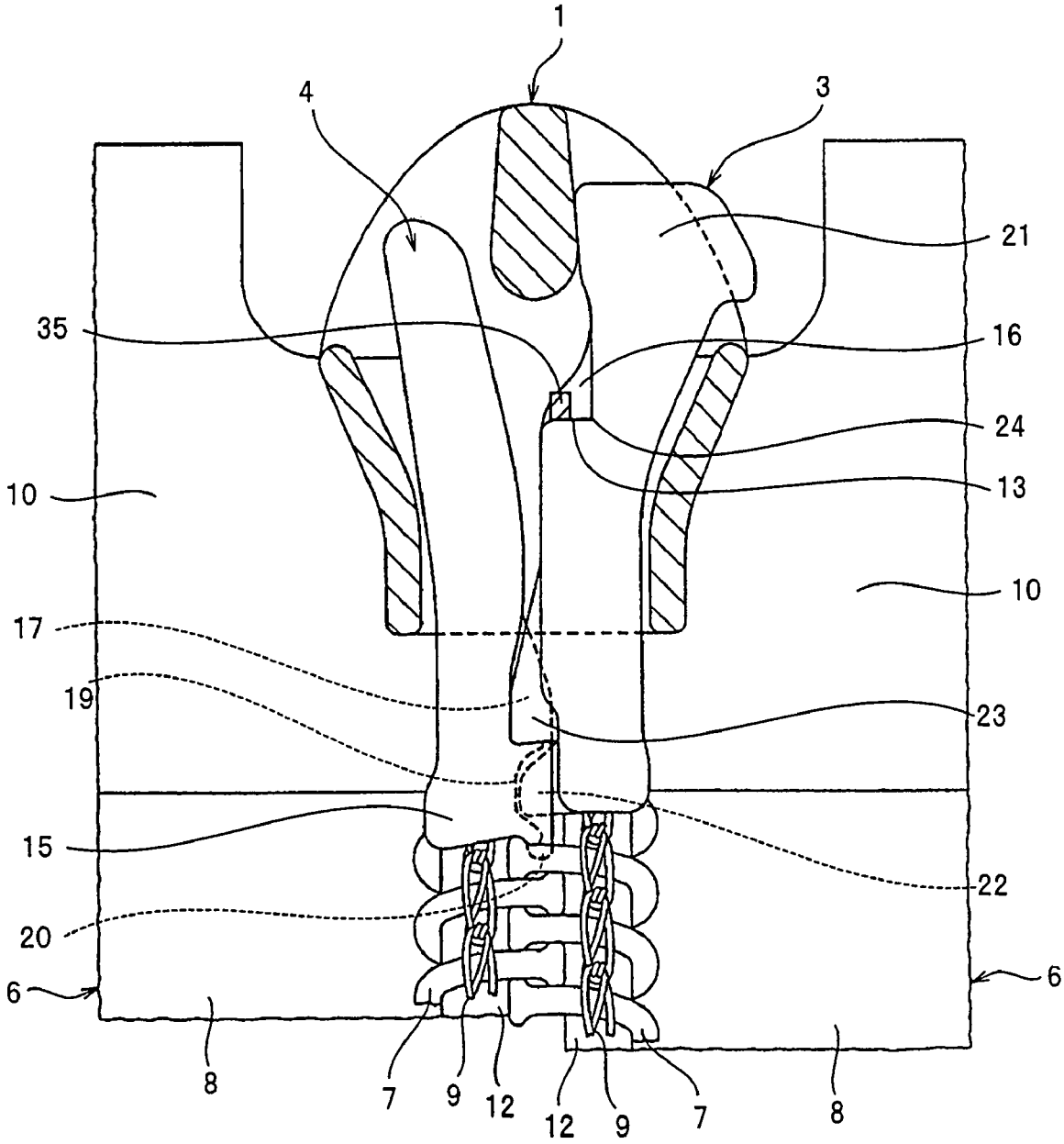
FIG. 14 is a sectional view of major portions showing a state in which insertion of the insert pin to a reverse opening type slider of the second embodiment is completed so that a box pin and a locking pawl engage each other.

A reverse opening type separable end stop of a slide fastener according to a second embodiment shown in FIGS. 13 and 14 is characterized in that a box pin 3 has a mechanism which blocks a reverse opening type slider 1 from moving inward of a fastener chain 5. A configuration of the fastener chain 5 is the same as that of the first embodiment. In the fastener chain 5, coil-like fastener elements 7 containing a core thread 12 inside are sewed along side edges in the longitudinal direction of fastener tapes 8, 8 of a pair of right and left fastener stringers 6, 6 with a sewing yarn 9. A reinforcement portion 10 is formed by bonding a resin film on a space portion 11 disposed at one end in the longitudinal direction of each of the fastener stringers 6, 6, and the box pin 3 is formed of a thermoplastic resin on the reinforcement portion 10 of the one fastener stringer 6 while the insert pin 4 is formed of a thermoplastic resin on the reinforcement portion 10 of the other fastener stringer 6.

The box pin 3 has the same configuration as the box pin 3 of the first embodiment except that the contact portion 13 and the notch portion 16 are provided. As shown in FIG. 13, a front end of the box pin 3 is projected sideway providing entirely a substantially L-shaped configuration, and the box pin 3 includes a hook portion 21, a first insertion piece 22, and a second insertion piece 23. The hook portion 21 projects inward of the fastener tape 8 from the inside surface at the front end of the box pin 3. The first insertion piece 22 projects outward of the fastener tape 8 from the outside surface at the proximal end adjacent to the fastener element 7. The second insertion piece 23 is disposed at a position nearer the front end of the box pin 3 than the first insertion piece 22 and projects from the outside surface of the box pin 3. The hook portion 21 blocks the reverse opening type slider 1 from slipping out of the box pin 3, and the first insertion piece 22 and the second insertion piece 23 are inserted into the first accommodating portion 19 and the second accommodating portion 18 disposed in the insert pin 4.

A notch portion 16 is formed at a position nearer the proximal end of the box pin 3 than the hook portion 21 by cutting out a boundary portion in a step-like fashion in which the surface and the outside surface of the box pin 3 intersect. While the box pin 3 is inserted into the element guide passage 32 in the reverse opening type slider 1, a locking pawl 35 of the reverse opening type slider 1 invades into the notch portion 16, thereby preventing the box pin 3 and the locking pawl 35 from making contact with each other. Further, the notch portion 16 is constructed as the contact portion 13 for its peripheral wall to be able to make contact with the locking pawl 35. The notch portion 16 provides a substantially triangular shape as the box pin 3 is seen in its plan view, and includes a lateral wall surface in which a peripheral wall of the notch portion 16 extends in a right-left direction of the box pin 3 and a longitudinal wall surface extending in a longitudinal direction of the box pin 3. The lateral wall surface and the longitudinal wall surface intersect at a position inside of the box pin 3, that is, at a position apart from the outside surface of the box pin 3 toward the inside surface, thereby forming a corner portion 24. The lateral wall surface of the notch portion 16 is a face directed in the back and forth direction of the reverse opening type slider 1 and comes into contact with an end surface in a back and forth direction of the locking pawl 35.

The insert pin 4 is not provided with the notch portion 16 and the contact portion 13, and other configuration is the same as that of the insert pin 4 of the first embodiment. As shown in FIG. 14, a front end of the insert pin 4 is curved in an arc shape inward of the fastener tape 8, and provides an entirely warped configuration. The insert pin 4 includes a first supporting portion 15 projecting outward of the fastener tape 8 from the outside surface at the proximal end adjacent to the fastener element 7 and a second supporting portion 17 which is disposed nearer the front end side of the insert pin 4 than the first supporting portion 15 and projected from the outside surface of the insert pin 4. A first accommodating portion 19 in a concave shape is provided on the rear surface side of the first supporting portion 15 while a second accommodating portion 18 in a concave shape is provided on the front surface side of the second supporting portion 17. Further, an engaging projection 20 for engaging the fastener element 7 on the box pin 3 side is provided at the front end of the first supporting portion 15.

In a state in which the box pin 3 and the insert pin 4 are inserted into the element guide passage 32 of the reverse opening type slider 1, the first insertion piece 22 of the box pin 3 is accommodated in the first accommodating portion 19 provided in the insert pin 4 while the second insertion piece 23 of the box pin 3 is accommodated in the second accommodating portion 18. Further, the first insertion piece 22 and the first supporting portion 15 overlap each other in the front and rear surface direction of the box pin 3 and the insert pin 4, and the second insertion piece 23 and the second supporting portion 17 overlap each other in the front and rear surface direction. In case of providing the box pin 3 with the contact portion 13, the insert pin 4 is of left side insertion type which is to be inserted into the element guide passage 32 on a left side across the diamond 33 of the reverse opening type slider 1. On the other hand, in the case of the first embodiment, the insert pin 4 is of right side insertion type which is to be inserted into the element guide passage 32 on a right side across the diamond 33.

The reverse opening type separable end stop of the slide fastener of the present invention is mounted on a fastener chain to be attached to, for example, an opening/closing portion of clothes or bags and a joint portion of carpet and artificial lawn, in order to prevent the reverse opening type slider from being moved freely without any intentional operation.

What is claimed is:

1. A slide fastener with a reverse opening separable end stop, comprising:

a fastener chain on which two sliders are mounted with rear ends thereof opposed to each other, the fastener chain comprising a pair of right and left fastener stringers on which a plurality of fastener elements are attached in a row along opposing side edges of two fastener tapes; and the reverse opening separable end stop comprising:

a box pin attached to one end of a row of the fastener elements of one of the fastener stringers; and an insert pin attached to one end of a row of the fastener elements of the other one of the fastener stringers, wherein:

one of the two sliders comprises a reverse opening slider into which the box pin and the insert pin are configured to be inserted, the insert pin comprises a contact portion that is configured for contacting a locking pawl, the locking pawl being provided inside the reverse opening slider so as to extend from a top surface of the slider and into and out of an element passage inside the slider, the contact portion projects from a part of a side surface of the insert pin in a direction toward the box pin, and the contact portion comprises a notch portion formed in a step-like fashion from a corner portion in which the front end portion of the contact portion on a side opposing to an element side and the side surface of the insert pin in a direction toward the box pin intersect to a front end on a free end side of the insert pin, and the notch portion allowing the locking pawl of the reverse opening slider to invade therein when the insert pin is inserted into the reverse opening slider, and when a side surface of the contact portion on a free end side of the insert pin comes into contact with the locking pawl, the side surface of the contact portion prevents the reverse opening slider from moving on the fastener chain toward the opposing slider.

2. The slide fastener with the reverse opening separable end stop according to claim 1, wherein the box pin has first and second insertion pieces projecting from a side surface thereof opposing the insert pin, and the insert pin has first and second accommodating portions capable of accommodating the insertion pieces of the box pin on a side surface thereof opposing the box pin, and the contact portion projecting toward the box pin while the contact portion and the insertion pieces are disposed at positions deflected in a front and rear surface direction of the box pin and the insert pin.

3. The slide fastener with the reverse opening separable end stop according to claim 1, wherein the contact portion of the insert pin is formed such that a width thereof gradually increases from a proximal end side of the insert pin near the elements toward a front end side near the free end.

* * * * *